United States Patent [19]

Kuttruf

[11] Patent Number: 4,977,816

[45] Date of Patent: Dec. 18, 1990

[54] HYDRAULIC MOTOR CONTROL SYSTEM WITH ROTATING SERVO-VALVE

[75] Inventor: Werner Kuttruf, Wuppertal, Fed. Rep. of Germany

[73] Assignee: BW Hydraulik GmbH, Wuppertal, Fed. Rep. of Germany

[21] Appl. No.: 502,577

[22] Filed: Mar. 30, 1990

[30] Foreign Application Priority Data

Apr. 19, 1989 [DE] Fed. Rep. of Germany ..... 3912743

[51] Int. Cl.[5] ..... F15B 9/09; F15B 9/10

[52] U.S. Cl. ..... 91/375 R; 91/467; 137/625.23; 137/625.24

[58] Field of Search ..... 137/625.23, 625.24; 91/180, 374, 375 R, 381, 467, 470

[56] References Cited

U.S. PATENT DOCUMENTS

| | | | |
|---|---|---|---|
| 2,349,641 | 5/1944 | Tucker et al. | 91/375 R X |
| 2,395,979 | 3/1946 | Tucker et al. | 91/375 R X |
| 3,185,439 | 5/1965 | Inaba et al. | 91/375 R X |
| 4,779,512 | 10/1988 | Leonard | 91/375 R X |
| 4,836,249 | 6/1989 | LaPointe | 137/625.23 |

FOREIGN PATENT DOCUMENTS

| | | | |
|---|---|---|---|
| 2532136 | 10/1976 | Fed. Rep. of Germany | 91/180 |
| 565154 | 7/1957 | Italy | 91/374 |
| 7902045 | 9/1980 | Netherlands | 137/625.24 |

*Primary Examiner*—Edward K. Look
*Assistant Examiner*—George Kapsalas
*Attorney, Agent, or Firm*—Robert W. Becker

[57] ABSTRACT

A hydraulic control mechanism to control operating elements, such as a hydraulic motor, or hydraulic cylinder, employing presetting of a set point, for example via a stepping motor, and mechanical feedback of an actual value. Functional elements are provided in the form of rotary pistons that fit inside one another, rotating relative to one another, and serving for the sensitive regulation of the direction and quantity of a pressure medium stream that is supplied from a pressure medium source to the operting element and flows back therefrom to the tank. One rotary piston is positively connected with the presetting of the set point, and the other rotary piston is positively connected with the operating element for the mechanical actual value feedback. In this way, in contrast to known control mechanisms where a slide or seat valve is actuated by a longitudinal movement, the rotational movement of the set point and actual value are directly compared with one another. This results in a considerably greater precision both statically (positioning precision, concentricity) as well as dynamically (sequence trueness, path deviation). The control mechanism is a better overload safety device, has a simpler construction, and is more economical.

7 Claims, 4 Drawing Sheets

HYDRAULIC MOTOR CONTROL SYSTEM WITH ROTATING SERVO-VALVE

BACKGROUND OF THE INVENTION

The present invention relates to a hydraulic control mechanism for an operating element, such as a hydraulic motor, hydraulic cylinder, or the like, with the control mechanism operating with or employing presetting of a set point, for example via a stepping motor, and mechanical indication or feedback of an actual value, whereby valve elements or means regulate the direction and quantity of a pressure medium stream that is supplied to the operating element from a source of pressure medium and that flows back from the operating element to the pressure medium tank.

Various control valve designs are used to build control circuits for controlling hydraulic operating elements. With such control circuits, the presetting of the set point and the feedback of an actual value are frequently effected via rotating components. With the heretofore known apparatus, the difference between the rotating components, which represent the set point and actual values, is converted via mechanical components (worm gears, spindles, toothed racks, etc.) into a linear movement that actuates the actual control valve. Thus, with one known apparatus, this control valve is embodied as a sliding spool, and with another known apparatus, the control valve is comprised of four individually arranged seat valves. Whereas the first mentioned approach makes it possible to have a relatively compact construction of the control valve, the second approach can be realized with only a relatively great outlay for functional components. Furthermore, both approaches have the drawback that mechanical elements are needed for the two-stage conversion of a rotational movement into a linear movement. These mechanical elements necessarily have a certain manufacturing tolerance that by reason of a series connection experiences an undesired summation. In addition, with both approaches additional devices are needed that in the manner of an overload safety device effect an automatic disconnect in the event of a danger of exceeding the control path.

It is an object of the present invention to provide a hydraulic control mechanism of the aforementioned general type that makes it possible to compare the rotational movements of set point and actual values directly with one another, via which a considerably greater precision in a static and dynamic sense can be achieved, which operates as an overload safety device, and which has a considerably more straightforward construction and hence can also be manufactured more economically, all relative to the heretofore known control mechanisms.

SUMMARY OF THE INVENTION

The hydraulic control mechanism of the present invention is characterized primarily by: a housing having a bore; a hollow piston that is rotatably mounted in the bore in such a way that it cannot shift axially, with the hollow piston being divided into five axially successive planes, in each of which is disposed at least one through-bore that extends transverse to an axis of the hollow piston, whereby the through-bore in each plane opens into a respective circumferential groove in the bore wall of the housing, with lines from the pressure medium source and tank, and lines of the operating element, being connected to the circumferential grooves; a central piston that is rotatably mounted in the hollow piston in such a way that it cannot shift axially, with the central piston comprising four individual pistons that are spaced from one another and are rigidly interconnected via rod sections, with the two central ones of the individual pistons being control pistons and being centrally disposed relative to the second and fourth ones of the hollow piston planes respectively, whereas each of the two individual pistons at the ends being spaced from an adjacent control piston by such a distance that an opening of a respective one of the through-bores disposed therebetween is exposed, whereby each of the control pistons, on a cylindrical outer surface thereof, is provided with at least two axially extending recesses that start from opposite end faces of that control piston and end before the other end face thereof, with the recesses being disposed in such a way that in a middle position of the control mechanism, facing axial control edges of the recesses touch the pertaining through-bores of the hollow piston; and means to individually positively connect the hollow piston and central piston via presetting of a set point and feedback of an actual value, possibly via a reduction or stepup gearing.

An important concept of the present invention is that the actual regulating valve is comprised of two concentric valve elements in the form of a hollow cylinder and a central piston, which are rotatably mounted in the bore of a housing in such a way that they cannot shift axially. The control edges are formed by axially extending recesses that are disposed in the outer surface of two control pistons of the central piston. If a relative movement takes place between the central piston and the hollow piston, this leads to a shifting at one of the total of four control edges, resulting in the release of the pressure medium and hence an actuation of the operating element. The mechanical feedback of an actual value associated herewith effects a corresponding "regulating response".

The fundamental difference relative to the known control mechanisms of this type is that the rotational movements of set point and actual values can be compared indirectly with one another. This means that the detour via the (two-stage) conversion into a linear movement with the aid of mechanical components, and the drawbacks related thereto, are avoided with the present invention. Such a control mechanism is a better overload safety device since the hollow cylinder and central piston can be infinitely adjusted relative to one another.

Depending upon existing requirements, it can be expedient to dispose in each bore plane, in the hollow piston, two or more aligned bores, and in conformity therewith also a double number of axial recesses in the control piston. In so doing, it is advantageous to adapt the width of the axial recesses of the control pistons to the inside diameter of the through-bores.

In a further advantageous specific embodiment of the present invention, the wall at the closed end of the axial recesses of the control pistons touches or projects beyond the wall of the pertaining through-bore of the hollow piston.

With regard to the connections for the lines that come from the outside, the following connections are provided on the housing:

(a) third (central) plane—line P from the source of pressure medium,
(b) first and fifth planes—line T to the tank, and
(c) second and fourth planes—lines A and B to the operating element.

The lines P and T as well as A and B are exchangeable for one another.

Further specific features of the present invention will be described in detail subsequently.

BRIEF DESCRIPTION OF THE DRAWINGS

Objects and advantages of the present invention appear in more detail in the following description and the accompanying schematic drawings, in which.

DESCRIPTION OF THE PREFERRED EMBODIMENTS

Figure 1:
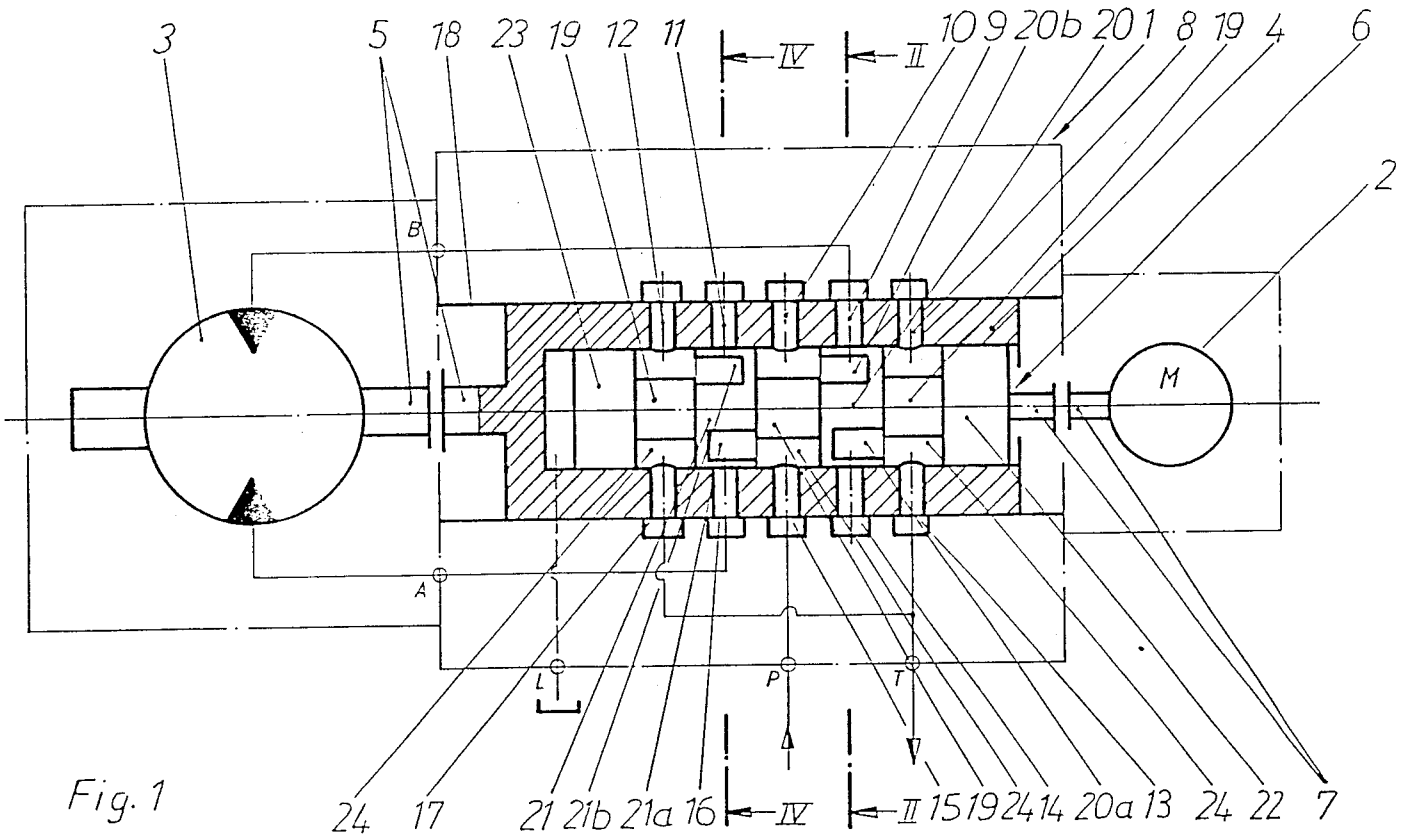
FIG. 1 is an axial cross-sectional view of one exemplary embodiment of the hydraulic control mechanism.

Referring now to the drawings in detail, the housing 1 of the hydraulic control mechanism is indicated in FIG. 1 by a dot-dash outline. Disposed at one end of the housing 1 is a stepping motor 2 for the presetting of the set point, and disposed at the opposite end is a hydraulic motor 3 as the operating element.

The housing 1 contains a cylindrical bore 18 in which a hollow piston 4 is held in a fluid-tight manner in such a way that this piston is rotatable yet cannot move in an axial direction. A fixed connection, possibly accompanied by the interposition of a reduction gearing, exists for the mechanical indication or feedback of the actual value via suitable gear means 5 disposed between the hydraulic motor 3 and the hollow piston 4.

A central piston 6 is mounted in a fluid-tight manner in the cylindrical bore of the hollow piston 4 in such a way that this piston 6 is rotatable yet cannot be shifted in an axial direction; the construction of the central piston 6 will be described subsequently. At its free end, the central piston 6 is fixedly connected to the stepping motor 2 via suitable gear means 7. An electrically operated motor of conventional design can be used as the stepping motor 2.

The hollow piston 4 is divided into five successive planes that are uniformly spaced from one another in an axial direction: each of these planes contains two through-bores 8 to 12 that are aligned with one another. In the following description, the individual planes will be referred to as the first to fifth planes as seen from the right toward the left in FIG. 1.

The through-bores 8 to 12 open outwardly into respective circumferential grooves 13 to 17 disposed in the wall of the bore 18 of the housing 1. Via internal connecting channels, the circumferential grooves 13 to 17 communicate with external connections of the housing 1. For example, the circumferential groove 15 in the central plane communicates with the external connection P, whereas the circumferential grooves 13, 17 in the first and fifth planes communicate with the external connection T. The circumferential groove 14 leads to the external connection B, and the circumferential groove 16 leads to the external connection A.

The central piston 6 comprises four individual pistons that are disposed one after the other in the axial direction; these individual pistons are rigidly interconnected via rod sections 19. The two central pistons 20 and 21 are the actual control pistons, while the pistons at the ends represent the end pistons 22 and 23. The control pistons 20 and 21 are symmetrically disposed in the second and fourth bore planes. The end pistons 22 and 23 are each spaced from the adjacent control piston by such a distance that the openings of the bores 8 and 12 disposed therebetween are exposed.

The preferably circular rod sections 19 have a smaller cross-sectional area than do the pistons of the central piston 6. Thus, between each two adjacent pistons free annular spaces 24 are provided for the flow of the pressure medium or hydraulic fluid.

In the illustrated embodiment, the cylindrical outer surfaces of the control pistons 20 and 21 are each provided with four axially extending recesses, with respectively diametrically oppositely disposed recesses forming a recess pair 20*a* and 20*b* or 21*a* and 21*b*. The recesses of a given pair begin on opposite end faces of the respective control piston 20 or 21 and extend in a radial direction over a large portion of the axial length of this control piston, with such recesses, however, ending at a certain distance before the respectively opposite end face (see in particular FIG. 1). The axial length of the recesses 20*a*, 20*b*, 21*a*, 21*b* is such that the wall at the closed end just releases the opening of the pertaining through-bore 9 or 11.

Figure 3:
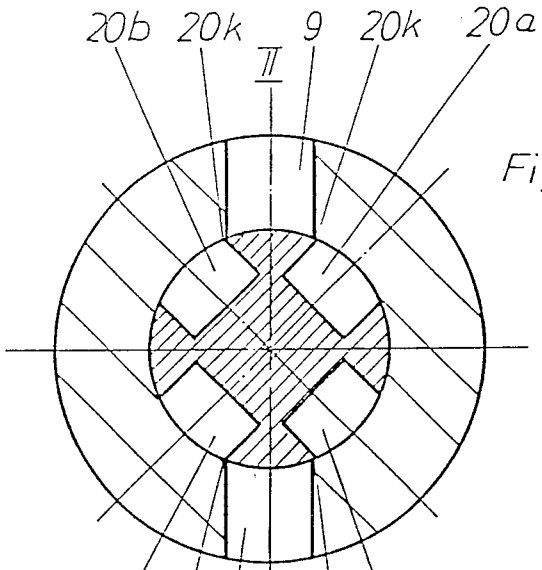
FIGS. 2 and 3 are cross-sectional views of the functional components of the hydraulic control mechanism of FIG. 1 taken in the planes II—II and IV—IV thereof for the operational condition "stabilized middle position"
Figure 2:
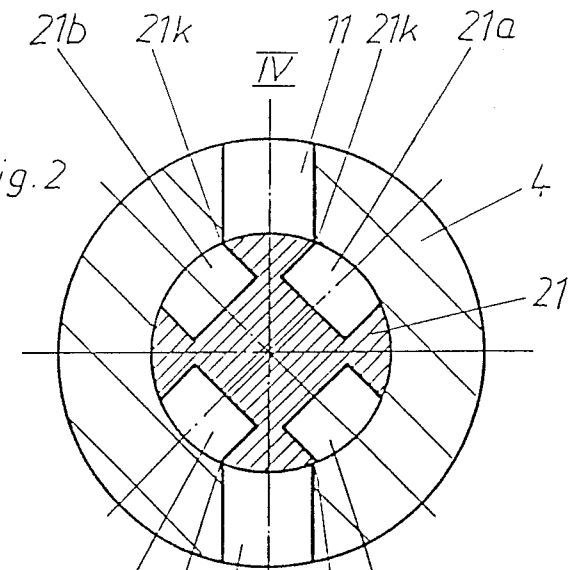

The spacial arrangement of the recesses of the control pistons 20 and 21 in the circumferential direction can be seen from the cross-sectional views of FIGS. 2 and 3, which show the central piston 6 in the middle position. In this position, with each pair of recesses the actual control edges 20*k* or 21*k* touch the surfaces of the pertaining through-bores 9 or 11. The width of the recesses of the control pistons 20 and 21 is adapted to the inside diameter of the through-bores 9 and 11.

Also shown in FIG. 1 on the housing 1 is a connection L that communicates via an inner passage with the interior of the hollow piston 4, which interior is delimited by the central piston 6. The connection L serves for the connection to a line that leads to a tank and serves for the withdrawal of possible leakage losses at the sealing surfaces of the functional components.

The possible operational conditions of the hydraulic control mechanism are explained subsequently.

Figure 4:
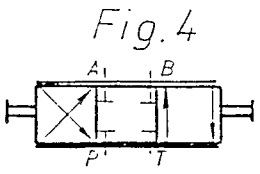
FIG. 4 shows the hydraulic symbol that conforms to the operational condition of FIGS. 2 and 3.

1. Operational condition "stabilized middle position" (FIGS. 2, 3 and 4)

In the position of the rotatable functional components, such as the hollow piston 4 and the central piston 6, illustrated in FIGS. 2 and 3, all of the outer connections P and T on the one hand and A and B on the other hand are blocked by the control pistons 20, 21. The hydraulic motor 3 is under the pressure of the medium (preload) on both sides, and thus assumes a "stabilized middle position".

Figure 6:
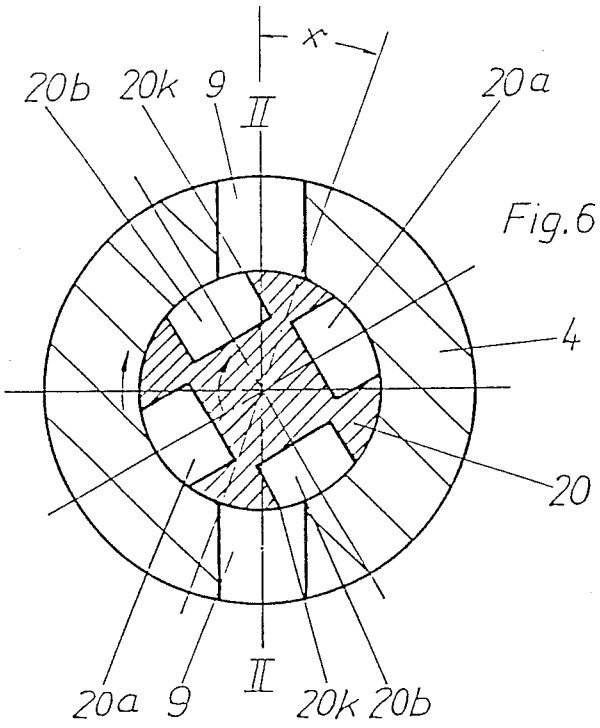
FIGS. 5 and 6 are cross-sectional views in the planes II—II and IV—IV of FIG. 1 for the operational condition "rotational movement toward the right"
Figure 5:
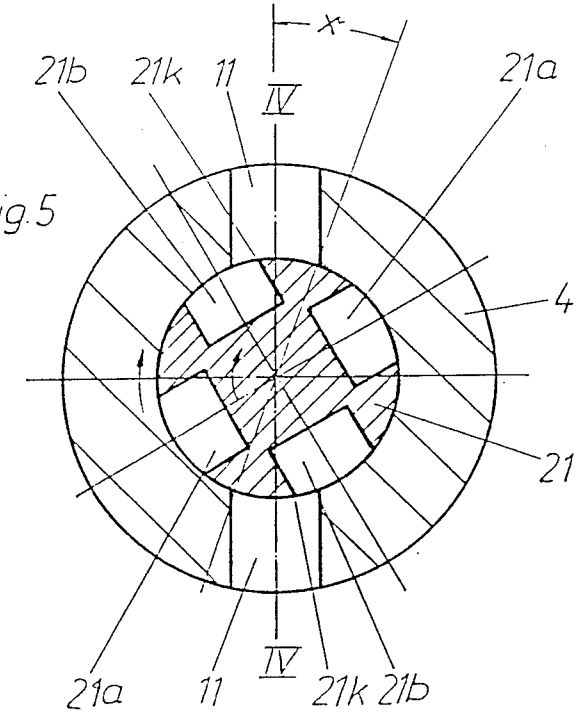
Figure 7:
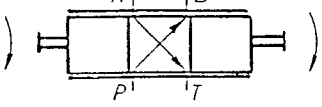
FIG. 7 shows the hydraulic symbol corresponding to the operational condition of FIGS. 5 and 6.

2. Operational condition "rotation toward the right" (FIGS. 5, 6, and 7)

The hollow piston 4 and the central piston 6 are rotated relative to one another by the angle x. The pressure medium flows from the connection P toward the connection B via the exposed passage between the axially extending recesses 20*b* of the control piston 20 and the through-bores 9, and furthermore flows from the connection A toward the connection T via the exposed passage of the axially extending recesses 21*b* of the control piston 21 and the through-bores 11. Thus, a defined oil stream that corresponds to the free cross-sectional area flows to the hydraulic motor 3 and back again.

If the central piston 6 is turned further toward the right, the quantity of oil that flows through to the hydraulic motor 3 and back is increased.

If the established flow quantity corresponds to the requested output of the hydraulic motor, the central piston 6 and the hollow piston 4 rotate at the same speed, so that the established flow-through quantity remains constant. The output and/or speed of the hydraulic motor 3 can be sensitively varied by altering the set point presetting of the stepping motor 2.

Figure 9:
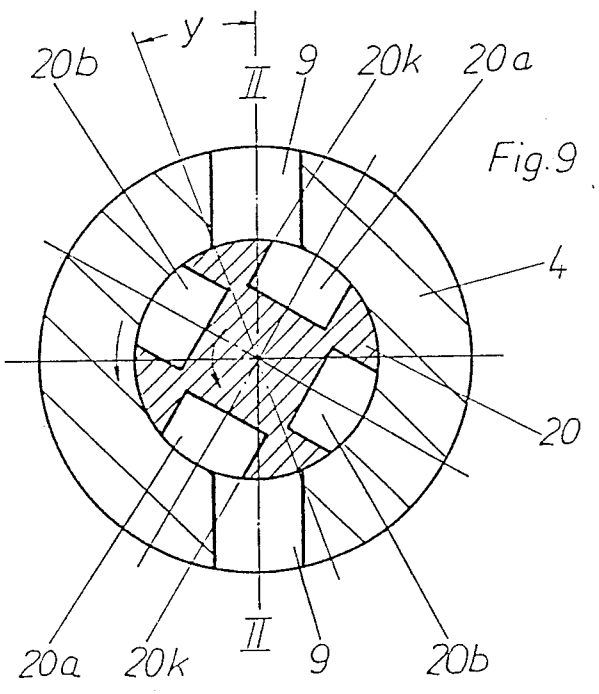
FIGS. 8 and 9 are cross-sectional views in the planes II—II and IV—IV in FIG. 1 for the operational condition "rotational movement toward the left"
Figure 8:
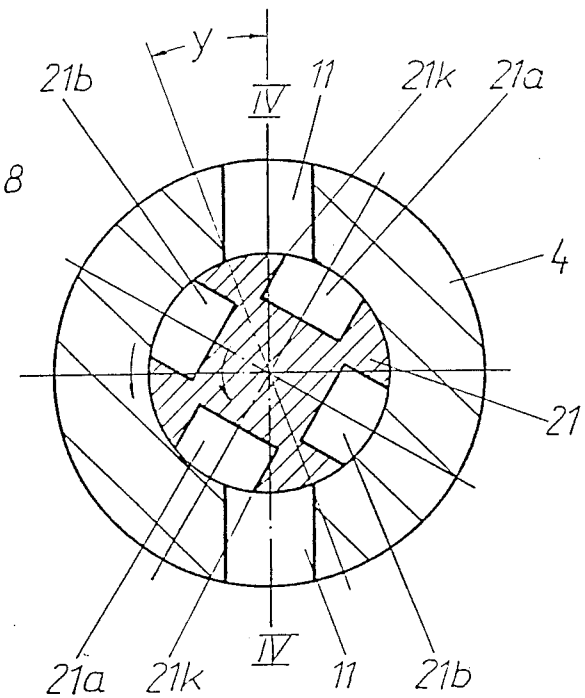
Figure 10:
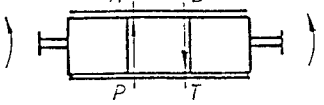
FIG. 10 shows the hydraulic symbol corresponding to the operational condition of FIGS. 8 and 9.

3. Operational condition "rotation toward the left" (FIGS. 8, 9, and 10)

The hollow piston 4 and the central piston 6 are rotated relative to one another by an angle y. The pressure medium flows from the connection P toward the connection A via the exposed passage between the axially extending recesses 21*a* of the control piston 21 and the through-bores 11, and further flows from the connection B toward the connection T via the exposed passage of the axially extending recesses 20*a* and the through-bores 9. Thus, a defined oil stream corresponding to the free cross-sectional area flows through the hydraulic motor 3, which in this condition rotates in the opposite direction to that described in conjunction with the previous operational condition.

If the central piston 6 is rotated further toward the left the flow-throuqh quantity to the hydraulic motor 3 and back is increased.

The present invention is, of course, in no way restricted to the specific disclosure of the specification and drawings, but also encompasses any modifications within the scope of the appended claims.

What I claim is:

1. In a hydraulic control mechanism for an operating element, such as a hydraulic motor, hydraulic cylinder, or the like, with said control mechanism employing presetting of a set point, for example via a stepping motor, and mechanical feedback of an actual value, whereby valve means regulate the direction and quantity of a pressure medium stream that is supplied to said operating element from a source of pressure medium and that flows back from said operating element to the pressure medium tank, the improvement wherein said control mechanism comprises:

a housing having a bore;

a hollow piston that is rotatably mounted in said bore in such a way that it cannot shift axially, with said hollow piston being divided into five axially successive planes, in each of which is disposed at least one through-bore that extends transverse to an axis of said hollow piston, whereby said through-bore in each plane opens into a respective circumferential groove in the bore wall of said housing, with lines from said pressure medium source and tank, and lines of said operating element, being connected to said circumferential grooves;

a central piston that is rotatably mounted in said hollow piston in such a way that it cannot shift axially, with said central piston comprising four individual pistons that are spaced from one another and are rigidly interconnected via rod sections, with the two central ones of said individual pistons being control pistons and being centrally disposed relative to the second and fourth ones respectively of said hollow piston planes, whereas each of the other two individual pistons at the ends being spaced from an adjacent control piston by such a distance that an opening of a respective one of said through-bores disposed therebetween is exposed, whereby each of said control pistons, on a cylindrical outer surface thereof, is provided with at least two axially extending recesses that start from opposite end faces of that control piston and end before the other end face thereof, with said recesses being disposed in such a way that in a middle position of said control mechanism, facing axial control edges of said recesses touch the pertaining through-bore of said hollow piston; and means to individually positively connect said hollow piston and said central piston with set point presetting means and actual value feedback means.

2. A control mechanism according to claim 1, in which said positive connection is effected via reduction or stepup gearing means.

3. A control mechanism according to claim 1, in which in each plane, said hollow piston contains at least two aligned through-bores, with said control pistons accordingly containing at least four axial recesses.

4. A control mechanism according to claim 3, in which the width of said axial recesses of said control pistons corresponds to the inside diameter of said through-bores.

5. A control mechanism according to claim 3, in which wall means of said control pistons at the closed end of said axial recesses thereof touch the walls of the pertaining through-bore of said hollow piston.

6. A control mechanism according to claim 3, in which wall means of said control pistons at the closed ends of said axial recesses thereof project beyond the walls of the pertaining through-bore of said hollow piston.

7. A control mechanism according to claim 3, in which said housing is provided with channel means to connect: said third and middle plane with a connection for said line from said pressure medium source; said first and fifth planes with a connection for said line to said tank; and said second and fourth planes with said connections for said lines to said operating element.

* * * * *